US008509465B2

(12) United States Patent
Theverapperuma

(10) Patent No.: US 8,509,465 B2
(45) Date of Patent: Aug. 13, 2013

(54) ENTRAINMENT AVOIDANCE WITH A TRANSFORM DOMAIN ALGORITHM

(75) Inventor: Lalin Theverapperuma, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1245 days.

(21) Appl. No.: 11/877,605

(22) Filed: Oct. 23, 2007

(65) Prior Publication Data

US 2008/0095388 A1 Apr. 24, 2008

Related U.S. Application Data

(60) Provisional application No. 60/862,530, filed on Oct. 23, 2006.

(51) Int. Cl.
*H04R 25/00* (2006.01)

(52) U.S. Cl.
USPC ..... 381/312; 381/320; 381/318; 381/316; 381/71.11; 381/71.2; 381/66

(58) Field of Classification Search
USPC ..... 381/312, 320, 318, 316, 71.11, 71.2, 381/66
See application file for complete search history.

(56) References Cited

U.S. PATENT DOCUMENTS

| | | | |
|---|---|---|---|
| 3,601,549 | A | 8/1971 | Mitchell |
| 4,495,643 | A | 1/1985 | Orban |
| 4,731,850 | A | 3/1988 | Levitt et al. |
| 4,783,817 | A | 11/1988 | Hamada et al. |
| 4,879,749 | A | 11/1989 | Levitt et al. |
| 4,985,925 | A | 1/1991 | Langberg et al. |
| 5,016,280 | A | 5/1991 | Engebretson et al. |
| 5,027,410 | A | 6/1991 | Williamson et al. |
| 5,091,952 | A | 2/1992 | Williamson et al. |
| 5,259,033 | A | 11/1993 | Goodings et al. |
| 5,276,739 | A | 1/1994 | Krokstad et al. |
| 5,402,496 | A | 3/1995 | Soli et al. |

(Continued)

FOREIGN PATENT DOCUMENTS

| | | | |
|---|---|---|---|
| DE | 19748079 | A2 | 5/1999 |
| EP | 0585976 | A2 | 3/1994 |

(Continued)

OTHER PUBLICATIONS

Francoise Beaufays, Transform-Domain Adaptive Filters: An Analytical Approach, Feb. 1995, IEEE Transaction on Signal Processing, vol. 43, No. 2, p. 422-431.*

(Continued)

*Primary Examiner* — Steven Loke
*Assistant Examiner* — Cuong B Nguyen
(74) *Attorney, Agent, or Firm* — Schwegman Lundberg & Woessner, P.A.

(57) ABSTRACT

A system of signal processing an input signal in a hearing aid to avoid entrainment, the hearing aid including a receiver and a microphone, the method comprising using a transform domain adaptive filter including two or more eigenvalues to measure an acoustic feedback path from the receiver to the microphone, analyzing a measure of eigenvalue spread against a predetermined threshold for indication of entrainment of the transform domain adaptive feedback cancellation filter, and upon indication of entrainment of the transform domain adaptive feedback cancellation filter, modulating the adaptation of the transform domain adaptive feedback cancellation filter.

20 Claims, 5 Drawing Sheets

(56) References Cited

U.S. PATENT DOCUMENTS

| | | | | |
|---|---|---|---|---|
| 5,502,869 | A | 4/1996 | Smith et al. | |
| 5,533,120 | A | 7/1996 | Staudacher | |
| 5,619,580 | A | 4/1997 | Hansen | |
| 5,621,802 | A | 4/1997 | Harjani et al. | |
| 5,668,747 | A | 9/1997 | Ohashi | |
| 6,072,884 | A | 6/2000 | Kates | |
| 6,173,063 | B1 | 1/2001 | Melanson | |
| 6,219,427 | B1 | 4/2001 | Kates et al. | |
| 6,356,606 | B1 | 3/2002 | Hahm | |
| 6,389,440 | B1 | 5/2002 | Lewis et al. | |
| 6,434,246 | B1 | 8/2002 | Kates et al. | |
| 6,434,247 | B1 * | 8/2002 | Kates et al. | 381/312 |
| 6,480,610 | B1 | 11/2002 | Fang et al. | |
| 6,498,858 | B2 | 12/2002 | Kates | |
| 6,552,446 | B1 | 4/2003 | Lomba et al. | |
| 6,563,931 | B1 | 5/2003 | Soli et al. | |
| 6,754,356 | B1 | 6/2004 | Luo et al. | |
| 6,831,986 | B2 | 12/2004 | Kates | |
| 7,058,182 | B2 | 6/2006 | Kates | |
| 7,065,486 | B1 | 6/2006 | Thyssen | |
| 7,519,193 | B2 | 4/2009 | Fretz | |
| 7,809,150 | B2 | 10/2010 | Natarajan et al. | |
| 7,995,780 | B2 | 8/2011 | Pedersen et al. | |
| 8,199,948 | B2 | 6/2012 | Theverapperuma | |
| 2001/0002930 | A1 | 6/2001 | Kates | |
| 2003/0026442 | A1 | 2/2003 | Fang et al. | |
| 2003/0031314 | A1 | 2/2003 | Tanrikulu et al. | |
| 2003/0185411 | A1 * | 10/2003 | Atlas et al. | 381/98 |
| 2004/0086137 | A1 | 5/2004 | Yu et al. | |
| 2004/0125973 | A1 | 7/2004 | Fang et al. | |
| 2005/0036632 | A1 | 2/2005 | Natarajan et al. | |
| 2005/0047620 | A1 | 3/2005 | Fretz | |
| 2006/0140429 | A1 | 6/2006 | Klinkby et al. | |
| 2007/0223755 | A1 | 9/2007 | Salvetti et al. | |
| 2008/0095389 | A1 | 4/2008 | Theverapperuma | |
| 2008/0130926 | A1 | 6/2008 | Theverapperuma | |
| 2008/0130927 | A1 | 6/2008 | Theverapperuma et al. | |
| 2009/0175474 | A1 | 7/2009 | Salvetti et al. | |
| 2011/0091049 | A1 | 4/2011 | Salvetti et al. | |
| 2011/0116667 | A1 | 5/2011 | Natarajan et al. | |
| 2012/0230503 | A1 | 9/2012 | Theverapperuma | |

FOREIGN PATENT DOCUMENTS

| | | | |
|---|---|---|---|
| EP | 1367857 | A1 | 12/2003 |
| EP | 1718110 | A1 | 2/2006 |
| EP | 2080408 | B1 | 8/2012 |
| WO | WO-0106746 | A2 | 1/2001 |
| WO | WO-0106812 | A1 | 1/2001 |
| WO | WO-0110170 | A2 | 2/2001 |
| WO | WO-2004105430 | A1 | 12/2004 |
| WO | WO-2008051569 | A2 | 5/2008 |
| WO | WO-2008051569 | A3 | 5/2008 |
| WO | WO-2008051570 | A1 | 5/2008 |
| WO | WO-2008051571 | A1 | 5/2008 |

OTHER PUBLICATIONS

T. W. Wong and C. P. Kwong, Adaptive Filtering Using Hartley Transform and Overlap-Saved Method, Jul. 1991, IEEE Transaction on Signal Processing, vol. 39, No. 7, p. 1708-1711.*

Haykin S., "Adaptive Filter Theory: 3rd Edition", Prentice Hall: Upper Saddle River, N.J, 1996, pp. 170-171.*

"Advance Adaptive Feedback Cancellation", *IntriCon: Technology White Paper*, [Online]. Retrieved from the Internet: <URL: http://www.intricondownloads.com/D1/techdemo/WP_Advanced_AFC_rev101006.pdf>, (Oct. 10, 2005), 3 pg.

"Entrainment (Physics)", [Online]. Retrieved from the Internet: <URL: http://en.wikipedia.org/w/index.php?title=Entrainment_(physics)&printable=yes>, (Jun. 18, 2009), 2 pgs.

"Inspiria Ultimate—GA3285", [Online]. Retrieved from the Internet: <URL: http://www.sounddesigntechnologies.com/products_InspiriaUltimate.php>, (Jun. 18, 2009), 4 pgs.

"International Application Serial No. PCT/US2007/022550, International Preliminary Report on Patentability mailed May 7, 2009", 8 pgs.

"International Application Serial No. PCT/US2007/022550, International Search Report and Written Opinion mailed Oct. 23, 2006", 12 pgs.

Beaufays, Francoise, "Transform-Domain Adaptive Filters: An Analytical Approach", *IEEE Trans. on Signal Proc.*, vol. 43(2), (Feb. 1995), 422-431.

"U.S. Appl. No. 11/877,606, Final Office Action mailed Dec. 2, 2011", 11 pgs.

"U.S. Appl. No. 12/336,460, Non Final Office Action mailed Sep. 29, 2011", 13 pgs.

"European Application Serial No. 07839768.4, Office Action Received Dec. 9, 2011", 3 pgs.

"U.S. Appl. No. 10/857,599, Final Office Action mailed Jun. 11, 2009", 7 pgs.

"U.S. Appl. No. 10/857,599, Final Office Action Mailed Jul. 24, 2008", 9 pgs.

"U.S. Appl. No. 10/857,599, Non-Final Office Action mailed Jan. 26, 2010", 8 pgs.

"U.S. Appl. No. 10/857,599, Non-Final Office Action mailed Dec. 26, 2007", 8 pgs.

"U.S. Appl. No. 10/857,599, Non-Final Office Action mailed Dec. 31, 2008", 6 pgs.

"U.S. Appl. No. 10/857,599, Notice of Allowance mailed Jul. 26, 2010", 10 pgs.

"U.S. Appl. No. 10/857,599, Response filed Apr. 26, 2010 to Non Final Office Action mailed Jan. 26, 2010", 8 pgs.

"U.S. Appl. No. 10/857,599, Response filed Apr. 28, 2008 to Non-Final Office Action mailed Dec. 26, 2007", 7 pgs.

"U.S. Appl. No. 10/857,599, Response filed Apr. 30, 2009 to Non-Final Office Action mailed Dec. 31, 2008", 7 pgs.

"U.S. Appl. No. 10/857,599, Response filed Nov. 12, 2009 to Final Office Action mailed Jun. 11, 2009", 9 pgs.

"U.S. Appl. No. 10/857,599, Response filed Nov. 16, 2007 to Restriction Requirement dated May 21, 2007", 6 pgs.

"U.S. Appl. No. 10/857,599, Response filed Nov. 24, 2008 to Final Office Action mailed Jul. 24, 2008", 9 pgs.

"U.S. Appl. No. 10/857,599, Restriction Requirement mailed May 21, 2007", 5 pgs.

"U.S. Appl. No. 11/276,763, Decision on Pre-Appeal Brief Request mailed Feb. 15, 2011", 3 pgs.

"U.S. Appl. No. 11/276,763, Final Office Action mailed Sep. 14, 2010", 9 pgs.

"U.S. Appl. No. 11/276,763, Non-Final Office Action mailed Apr. 2, 2010", 11 pgs.

"U.S. Appl. No. 11/276,763, Notice of Allowance mailed Aug. 25, 2011", 8 pgs.

"U.S. Appl. No. 11/276,763, Pre-Appeal Brief Request filed Jan. 14, 2011", 5 pgs.

"U.S. Appl. No. 11/276,763, Response filed Jan. 11, 2010 to Restriction Requirement mailed Dec. 10, 2009", 9 pgs.

"U.S. Appl. No. 11/276,763, Response filed Jun. 15, 2011 to Final Office Action mailed Sep. 14, 2010", 10 pgs.

"U.S. Appl. No. 11/276,763, Response filed Jul. 2, 2010 to Non Final Office Action mailed Apr. 2, 2010", 15 pgs.

"U.S. Appl. No. 11/276,763, Restriction Requirement mailed Dec. 10, 2009", 6 pgs.

"U.S. Appl. No. 11/877,317, Non Final Office Action mailed Aug. 18, 2011", 16 pgs.

"U.S. Appl. No. 11/877,567, Non Final Office Action mailed Sep. 1, 2011", 17 pgs.

"U.S. Appl. No. 11/877,606, Non Final Office Action mailed Jun. 10, 2011", 12 pgs.

"U.S. Appl. No. 11/877,606, Response filed Sep. 12, 2011 to Non-Final Office Action mailed Jun. 10, 2011", 7 pgs.

"European Application Serial No. 07250899.7, European Search Report mailed May 15, 2008", 7 pgs.

"European Application Serial No. 07250899.7, Office Action Mailed Jan. 15, 2009", 1 pgs.

"European Application Serial No. 07250899.7, Office Action mailed Mar. 21, 2011", 3 pgs.

"European Application Serial No. 07250899.7, Response to Official Communication Filed Jul. 13, 2009", 17 pgs.

"European Application Serial No. 07839767.6, Office Action mailed May 5, 2011", 4 pgs.
"European Application Serial No. 07839767.6, Response filed Jun. 2, 2011 to Office Action mailed May 5, 2011", 11 pgs.
"International Application Serial No. PCT/US2007/022548, International Preliminary Report on Patentability mailed May 7, 2009", 8 pgs.
"International Application Serial No. PCT/US2007/022548, Search Report mailed Jun. 3, 2008", 7 pgs.
"International Application Serial No. PCT/US2007/022548, Written Opinion mailed Jun. 3, 2008", 8 pgs.
"International Application Serial No. PCT/US2007/022549, International Preliminary Report on Patentability mailed May 7, 2009", 8 pgs.
"International Application Serial No. PCT/US2007/022549, International Search Report and Written Opinion mailed Feb. 15, 2008", 12 pgs.
Chankawee, A., et al., "Performance improvement of acoustic feedback cancellation in hearing aids using liner prediction", Digital Signal Processing Research Laboratory(DSPRL), (Nov. 21, 2004), 116-119.
Lalin, S. T, et al., "Adaptive Feedback Canceller: Entrainment", Digital Signal Processing Workshop, 4th IEEE, PI, (Sep. 1, 2006), 245-250.
Lalin, S. T, et al., "Continuous Adaptive Feedback Canceller Dynamics", Circuits and Systems, 49TH IEEE International Midwes T Symposium on, IEEE, PI, (Aug. 1, 2006), 605-609.
Maxwell, J. A., et al., "Reducing Acoustic Feedback in Hearing Aids", IEEE Transactions on Speech and Audio Processing, 3(4), (Jul. 1995), 304-313.
Proakis, J. G, et al., "Digital Signal Processing", Prentice-Hall, Inc., XP002481168, (1996), 213-214-PAGE536.
Rife, D., et al., "Transfer-Function Measurement With Maximum-Length Sequences", J. Audio Eng. Soc., 37(6), (1989), 419-444.
"U.S. Appl. No. 11/877,317, Notice of Allowance mailed Jun. 1, 2012", 12 pgs.
"U.S. Appl. No. 11/877,317, Response filed Feb. 20, 2012 to Non Final Office Action mailed Aug. 18, 2011", 9 pgs.
"U.S. Appl. No. 11/877,567, Notice of Allowance mailed May 31, 2012", 11 pgs.
"U.S. Appl. No. 11/877,606, Examiner Interview Summary mailed Feb. 8, 2012", 1 pg.
"U.S. Appl. No. 11/877,606, Notice of Allowance mailed Feb. 15, 2012", 10 pgs.
"U.S. Appl. No. 11/877,606, Response filed Feb. 2, 2012 to Final Office Action mailed Dec. 2, 2011", 9 pgs.
"U.S. Appl. No. 12/336,460 , Response filed Jun. 27, 2012 to Final Office Action mailed Apr. 27, 2012", 10 pgs.
"U.S. Appl. No. 12/336,460, Final Office Action mailed Apr. 27, 2012", 8 pgs.
"U.S. Appl. No. 12/336,460, Response filed Jan. 30, 2012 to Non Final Office Action mailed Sep. 29, 2011", 25 pgs.
"U.S. Appl. No. 12/875,646, Non Final Office Action mailed Jan. 30, 2012", 4 pgs.
"European Application Serial No. 07839768.4, Response filed Apr. 5, 2012 to Office Action mailed Dec. 9, 2011", 20 pgs.
Haykin, Simon, "Adaptive Filter Theory: Third Edition: Appendix G Gradient Adaptive Lattice Algorithm", Prentice Hall, (1996), 5 pgs.
U.S. Appl. No. 11/877,317, Notice of Allowance mailed Jan. 31, 2013, 8 pgs.
U.S. Appl. No. 11/877,317, Notice of Allowance mailed Sep. 17, 2012, 8 pgs.
U.S. Appl. No. 11/877,567, Notice of Allowance mailed Sep. 28, 2012, 8 pgs.
U.S. Appl. No. 12/336,460, Advisory Action mailed Jul. 30, 2012, 3 pgs.
U.S. Appl. No. 12/336,460, Non Final Office Action mailed Nov. 26, 2012, 6 pgs.
U.S. Appl. No. 12/875,646, Final Office Action mailed Oct. 25, 2012, 10 pgs.
U.S. Appl. No. 12/875,646, Response filed Jul. 30, 2012 to Non Final Office Action mailed Jan. 30, 2012, 7 pgs.
European Application Serial No. 07839766.8, Office Action mailed Jun. 8, 2009, 2 pgs.
European Application Serial No. 07839766.8, Office Action mailed Jul. 2, 2009, 2 pgs.
European Application Serial No. 07839766.8, Office Action mailed Sep. 17, 2012, 10 pgs.
European Application Serial No. 07839766.8, Response filed Jan. 11, 2013 to Office Action mailed Sep. 17, 2012, 16 pgs.
European Application Serial No. 07839767.6, Office Action mailed Mar. 8, 2012, 27 pgs.
European Application Serial No. 07839767.6, Decision to Grant mailed Jul. 19, 2012, 2 pgs.
Jenkins, W. Kenneth, et al., "Chapter 22—Transform Domain Adaptive Filtering", The Digital Signal Processing Handbook, Editors, Vijay K. Madisetti, Douglas B. Williams; Boca Raton, FL:CRC Press, (1998), 22-1-22-20.
Spreiet, Ann, et al., "Adaptive Feedback Cancellation in Hearing Aids With Linear Prediction of the Desired Signal", IEEE Transactions on Signal Processing 53(10), (Oct. 2005), 3749-3763.
Theverapperurna, Lalin S, et al., "Adaptive Feedback Canceller: Entrainment", Digital Signal Processing Workshop, 12th—Signal Processing Education Workshop, 4th, IEEE, (2006), 245-250.

* cited by examiner

ENTRAINMENT AVOIDANCE WITH A TRANSFORM DOMAIN ALGORITHM

CLAIM OF PRIORITY AND RELATED APPLICATION

This application claims the benefit under 35 U.S.C. 119(e) of U.S. Provisional Patent Application Ser. No. 60/862,530, filed Oct. 23, 2006, the entire disclosure of which is hereby incorporated by reference in its entirety.

TECHNICAL FIELD

The present subject matter relates generally to adaptive filters and in particular to method and apparatus to reduce entrainment-related artifacts for hearing assistance systems.

BACKGROUND

Digital hearing aids with an adaptive feedback canceller usually suffer from artifacts when the input audio signal to the microphone is periodic. The feedback canceller may use an adaptive technique, such as a N-LMS algorithm, that exploits the correlation between the microphone signal and the delayed receiver signal to update a feedback canceller filter to model the external acoustic feedback. A periodic input signal results in an additional correlation between the receiver and the microphone signals. The adaptive feedback canceller cannot differentiate this undesired correlation from that due to the external acoustic feedback and borrows characteristics of the periodic signal in trying to trace this undesired correlation. This results in artifacts, called entrainment artifacts, due to non-optimal feedback cancellation. The entrainment-causing periodic input signal and the affected feedback canceller filter are called the entraining signal and the entrained filter, respectively.

Entrainment artifacts in audio systems include whistle-like sounds that contain harmonics of the periodic input audio signal and can be very bothersome and occurring with day-to-day sounds such as telephone rings, dial tones, microwave beeps, instrumental music to name a few. These artifacts, in addition to being annoying, can result in reduced output signal quality. Thus, there is a need in the art for method and apparatus to reduce the occurrence of these artifacts and hence provide improved quality and performance.

SUMMARY

This application addresses the foregoing needs in the art and other needs not discussed herein. Method and apparatus embodiments are provided for a system to avoid entrainment of feedback cancellation filters in hearing assistance devices. Various embodiments include using a transform domain filter to measure an acoustic feedback path and monitoring the transform domain filter for indications of entrainment. Various embodiments include comparing a measure of eigenvalue spread of transform domain filter to a threshold for indication of entrainment of the transform domain filter. Various embodiments include suspending adaptation of the transform domain filter upon indication of entrainment.

Embodiments are provided that include a microphone, a receiver and a signal processor to process signals received from the microphone, the signal processor including a transform domain adaptive cancellation filter, the transform domain adaptive cancellation filter adapted to provide an estimate of an acoustic feedback path for feedback cancellation. Various embodiments provided include a signal processor programmed to suspend the adaptation of the a transform domain adaptive cancellation filter upon an indication of entrainment of the a transform domain adaptive cancellation filter.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

Figure 1:
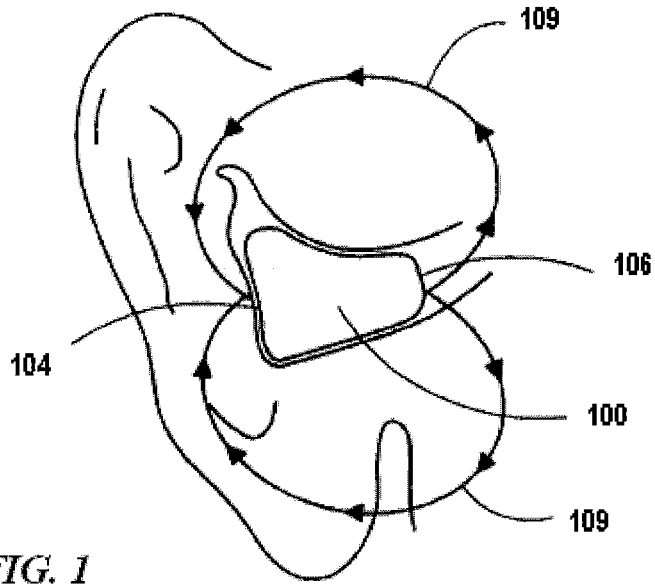
FIG. 1 is a diagram demonstrating, for example, an acoustic feedback path for one application of the present system relating to an in the ear hearing aid application, according to one application of the present system.

FIG. 1 is a diagram demonstrating, for example, an acoustic feedback path for one application of the present system relating to an in-the-ear hearing aid application, according to one embodiment of the present system. In this example, a hearing aid 100 includes a microphone 104 and a receiver 106. The sounds picked up by microphone 104 are processed and transmitted as audio signals by receiver 106. The hearing aid has an acoustic feedback path 109 which provides audio from the receiver 106 to the microphone 104. It is understood that the invention may be applied to variety of other systems, including, but not limited to, behind-the-ear hearing systems, in-the-canal hearing systems, completely-in-the-canal hearing systems and systems incorporating improved hearing assistance programming and variations thereof.

Figure 2:
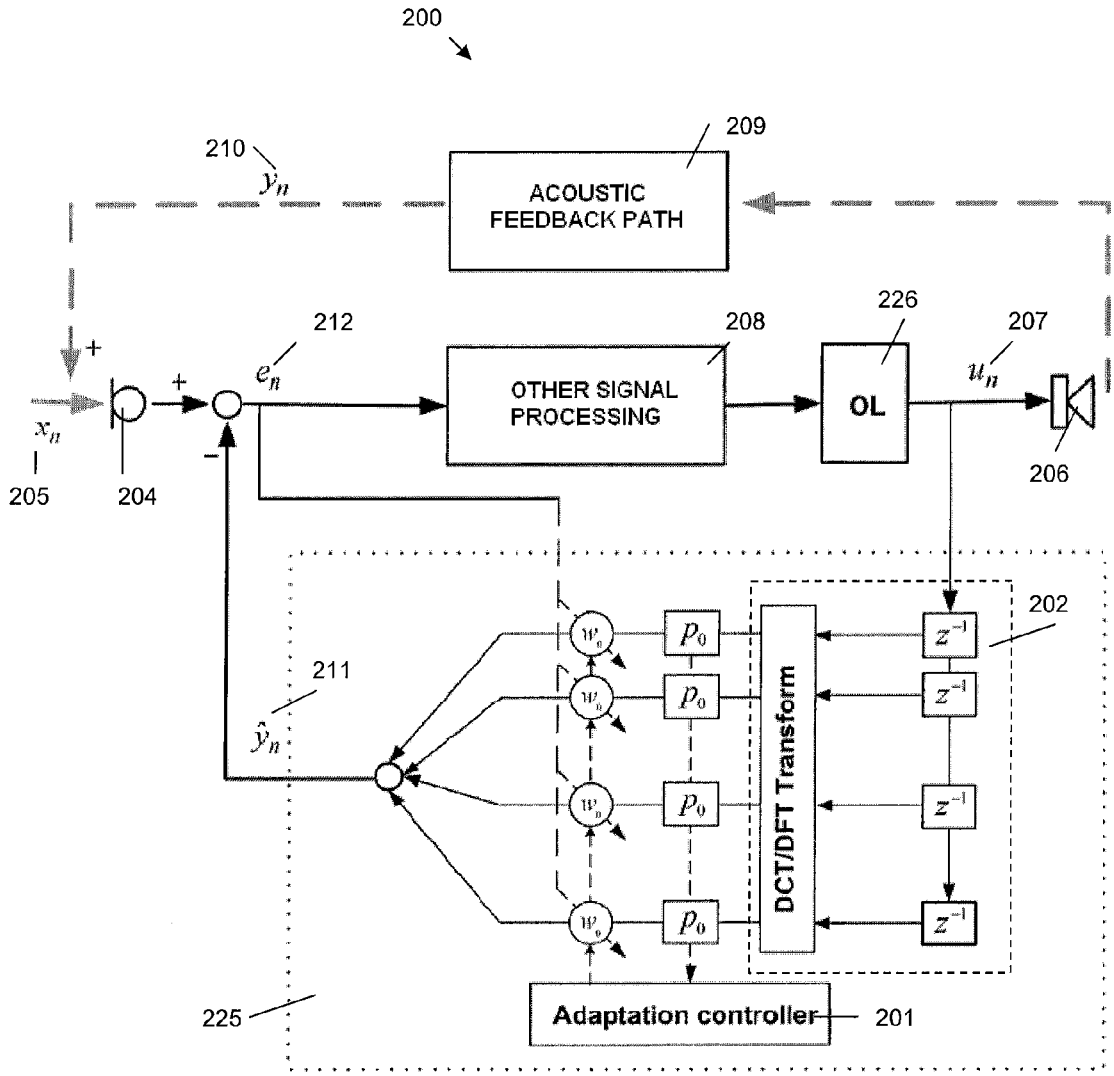
FIG. 2 illustrates an acoustic system with an adaptive feedback cancellation filter according to one embodiment of the present subject matter.

FIG. 2 illustrates an acoustic system 200 with an adaptive feedback cancellation filter 225 according to one embodiment of the present subject matter. FIG. 2 also includes a input device 204, such as a microphone, an output device 206, such as a speaker, a signal processing module 208 for processing and amplifying a compensated input signal $e_n$ 212, an acoustic feedback path 209 and acoustic feedback path signal $y_n$ 210. In various embodiments, the adaptive feedback cancellation filter 225 mirrors the acoustic feedback path 209 transfer function and signal $y_n$ 210 to produce a feedback cancellation signal $\hat{y}_n$ 211. When the feedback cancellation signal $\hat{y}_n$ 211 is subtracted from the input signal $x_n$ 205, the resulting compensated input signal $e_n$ 212 contains minimal, if any, feedback path 209 components. In one example, the adaptive feedback canceller 225 includes a pre-filter 202 to separate the input 207 of the adaptive feedback cancellation filter 225 into eigen components. In addition to updating the weights 226 of the filter to mirror the feedback path 209, in various embodiments, an adaptation controller 201 monitors the spread of the pre-filter eigenvalues to detect entrainment. In various embodiments, the eigenvalue spread is analyzed against a predetermined threshold. In various embodiments, when the eigenvalue spread exceeds the threshold, adaptation is suspended to eliminate entrainment artifacts generated by the adaptive feedback cancellation filter 225. In various embodiments, the signal processing module includes an output limiter stage 226. The output limiting stage 226 is used to avoid the output $u_n$ from encountering hard clipping. Hard clippings can result unexpected behavior. In various embodiments, the physical receiver and gain stage limitations produce the desired clipping effect. Clippings is common during entrainment peaks and instabilities. During experimentation, a sigmoid clipping unit that is linear from −1 to 1 was used to achieve the linearity without affecting the functionality.

Figure 3A:
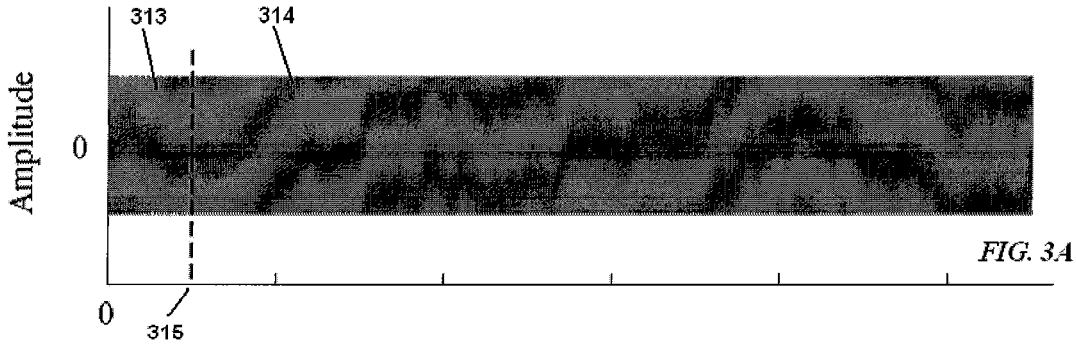
FIGS. 3A-C illustrate the response of an adaptive feedback system with using a transform domain algorithm according one embodiment of the present subject matter, but without compensating the adaptation in light of the eigenvalue spread.
Figure 3B:
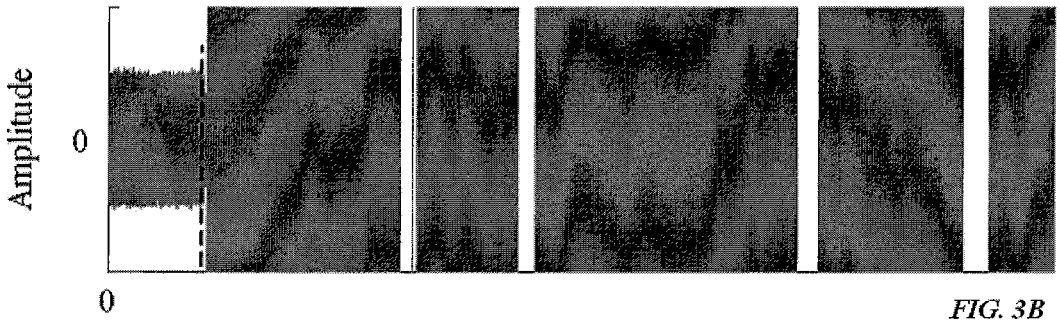
Figure 3C:
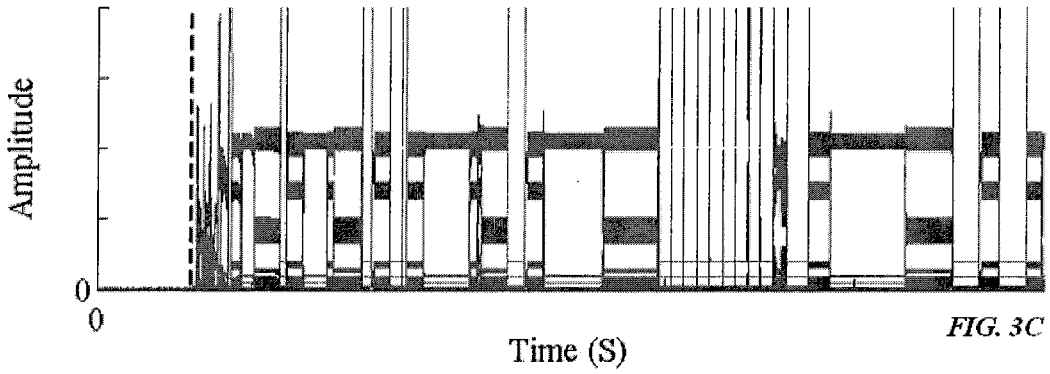

FIGS. 3A-C illustrate the response of an adaptive feedback system with using a transform domain algorithm according one embodiment of the present subject matter, but without compensating the adaptation in light of the eigenvalue spread. The input to the system includes a interval of white noise 313 followed by interval of tonal input 314 as illustrated in FIG. 3A. FIG. 3B illustrates the output of the system in response to the input signal of FIG. 3A. As expected, the system's output tracks the white noise input signal during the initial interval 313. When the input signal changes to a tonal signal at 315, FIG. 3B shows the system is able to output an attenuated signal for a short duration before the adaptive feedback begins to entrain to the tone and pass entrainment artifacts 316 to the output. The entrainment artifacts are illustrated by the periodic amplitude swings in the output response of FIG. 3B. FIG. 3C shows a representation of eigen values during application of the input signal of FIG. 3A. During the white noise interval the eigen values maintained a narrow range of values compared to the eigenvalues during the tonal interval of the input signal.

In various embodiments of the present subject matter, eigenvalue spread of an input signal autocorrelation matrix provides indication of the presence of correlated signal components within an input signal. As correlated inputs cause entrainment of adaptive, or self-correcting, feedback cancellation algorithms, entrainment avoidance apparatus and methods discussed herein, use the relationship of various autocorrelation matrix eigenvalues to control the adaptation of self-correcting feedback cancellation algorithms. Various embodiments use transform domain algorithms to separate the input signal into eigen components and then use various adaptation rates for each eigen component to improve convergence of the adaptive algorithm to avoid entrainment.

The convergence speed of an adaptive algorithm varies with the eigenvalue spread of the input autocorrelation matrix. The system input can be separated into individual modes (eigen modes) by observing the convergence of each individual mode of the system. For the system identification configuration, the number of taps represents the number of modes in the system. For gradient decent algorithms, the overall system convergence is a combination of convergence of separate modes of the system. Each individual mode is associated with an exponential decaying Mean Square Error (MSE) convergence curve. For smaller adaptation rate parameters with the steepest decent algorithm, the convergence time constants for the individual modes are approximated with, $$\tau_{k,mse} \approx \frac{1}{2\mu\lambda_k}$$

where $\tau_{k,mse}$ is a time constant which corresponds to the $k^{th}$ mode, $\lambda_k$ is the $k^{th}$ eigenvalue of the system and $\mu$ is the adaptation rate. The above equation shows that the smaller eigen modes take longer to converge for a given step size parameter. Conversely, large adaptation rates put a limit on the stability and minimum convergence error. In various embodiments, better convergence properties are obtained by reducing the eigenvalue spread or changing the adaptation rate based on the magnitude of the eigenvalues. Predetermined convergence is achieved by separating the signal into eigen components. Pre-filtering the input signal with Karhunen Leve Transform (KLT) will separate the signal into eigen components. Selecting an adaptation rate based on the magnitude of each component's eigenvalues allows varying degrees of convergence to be achieved. For a real time system, it is not necessary, or practical, to know the spectra of the input signal in detail to use this data dependent transform.

In practice, the Discrete Cosine Transforms (DCT), Discrete Fourier Transforms (DFT) and Discrete Hartley Transforms (DHT) based adaptive systems [33] are used to decorrelate signals. Transform domain adaptive filters exploit the de-correlation properties of these data independent transforms. Most real life low frequency signals, such as acoustic signals, can be estimated using DCTs and DFTs.

Transform domain LMS algorithms, including DCT-LMS and DFT-LMS algorithms, are suited for block processing. The transforms are applied on a block of data similar to block adaptive filters. Use of blocks reduce the complexity of the system by a factor and improves the convergence of the system. By using block processing, it possible to implement these algorithms with O(m) complexity, which is attractive from a computation complexity perspective. Besides entrainment avoidance, these algorithms improve the convergence for slightly correlated inputs signals due to the variable adaptation rate on the individual modes.

The feedback canceller input signal $u_n$ is transformed by a pre-selected unitary transformation, $$\bar{u}_i = u_i T$$

where the $u_i = [u_i, u_{i-1}, \ldots u_{i-M+1}]$ and T is the transform.

For a DFT transform case, T matrix becomes, $$[T]_{km} = \frac{1}{\sqrt{M}} e^{-\frac{j2\pi mk}{M}} \quad k, m = 0, 1, \ldots M-1$$

the scaling factor, $\sqrt{M}$, makes the regular DFT the transform unitary, $T T^* = I$.

For a DCT algorithm, the transform is, $$[T]_{km} = \alpha(0)\cos\left(\frac{k(2m-1)\pi}{2M}\right) \quad k, m = 0, 1, \ldots M-1$$

where $$\alpha(0) = \frac{1}{\sqrt{M}} \text{ and } \alpha(k) = \sqrt{\frac{2}{M}} \text{ for } k \neq 0.$$

For the system identification configuration, the error signal is calculated as the difference between the desired signal and the approximated signal, $e(i)=d(i)-u_i^T W$. For the case of the feedback canceller configuration, the error signal is given by, $$e_i=y_i-\hat{y}_i+x_i.$$

With the transformation of the input signal to DCT/DFT domain, $\bar{u}_i=u_i T$ changes the input autocorrelation matrix to, $$\begin{aligned} R_{\bar{u}_i} &= E\{\bar{u}_i^* \bar{u}_i\} \\ &= T^* E\{u_i^* u_i\} T \\ &= T^* R_{u_i} T. \end{aligned}$$

The derivation of the transform domain algorithm starts using the LMS algorithm, $$W_{i+1}=W_i+\mu u_i^* e_i$$

where $e_i=y_i-W^T u_i+x_i$ for the feedback canceller configuration. Applying the transform T, $$TW_{i+1}=TW_i+T\mu u_i^* e_i.$$

Applying the transformed weight vector $\overline{W}_i=TW_i$, $$\overline{W}_{i+1}=\overline{W}_i+T\mu u_i^* e_i.$$

Applying the input vector from above, $\bar{u}_i=u_i T$, $$\overline{W}_{i+1}=\overline{W}_i+\mu\bar{u}_i^*\lfloor y_i-u_i^T W_i+x_i\rfloor$$

The unitary transform gives, $$u_i^T W_i=u_i^T T^T T W_i=\bar{u}_i^T \overline{W}_i$$

$$\overline{W}_{i+1}=\overline{W}_i+\mu\bar{u}_i^*\lfloor y_i-u_i^T W_i+x_i\rfloor$$

Power normalization based on the magnitude of the de-correlated components is achieved by normalizing the update of the above equation with $D^{-1}$, $$\overline{W}_{i+1}=\overline{W}_i+\mu D^{-1}\bar{u}_i^*\lfloor y_i-u_i^T W_i+x_i\rfloor$$

where D is an energy transform. The power normalization matrix can be united to a single transform matrix by choosing a transform $T'=TD^{-1/2}$. The weight vector, $W_i$, and the input signal get transformed to $$u'_i=u_i TD^{-1/2}=u_i T'$$

$$W'_i=TD^{-1/2}W_i=T'W_i$$

After de-correlating the entries of $\bar{u}_i$, the uncorrelated power of each mode can be estimated by, $$\lambda_i(k)=\beta\lambda_{i-1}(k)+(1-\beta)|\hat{u}_i(k)|^2,\ k=0, 1, \ldots, M-1$$

and the weights are updated using, $$\overline{W}_{i+1} + \overline{W}_i + \frac{\mu}{\lambda_i(k)}\bar{u}_i^* e_i.$$

It is important to note that unitary transforms do not change the eigenvalue spread of the input signal. A unitary transform is a rotation that brings eigen vectors into alignment with the coordinated axes.

Experimentation shows the DCT-LMS algorithms perform better than the DFT-LMS algorithms. Entrainment avoidance includes monitoring the eigenvalue spread of the system and determining a threshold. When eigenvalue spread exceeds the threshold, adaptation is suspended. The DCT LMS algorithm uses eigenvalues in the normalization of eigen modes and it is possible to use these to implement entraimnent avoidance. A one pole smoothed eigenvalue spread is given by, $$\zeta_i(k)=\gamma\zeta_{i-1}(k)+(1-\gamma)\lambda_i(k),\ k=0, 1, \ldots, M-1$$

where $\zeta_i(k)$ is the smoothed eigenvalue magnitude and $\gamma<1$ is a smoothing constant. The entrainment is avoided using the condition number that can be calculated by, $$\frac{\text{Maximum}(\zeta_i)}{\text{Minimum}(\zeta_i)} = \psi,$$

where $\psi$ is a threshold constant selected based on the adaptation rate and the eigenvalue spread for typical entrainment prone signals. In various embodiments, as the ratio exceeds $\psi$, adaptation is suspended. In various embodiments, as the adaptation rate in creases beyond $\psi$, the adaptation rate is reduced. Adaptation is resumed when the value of the ratio is less than $\psi$.

Figure 5:
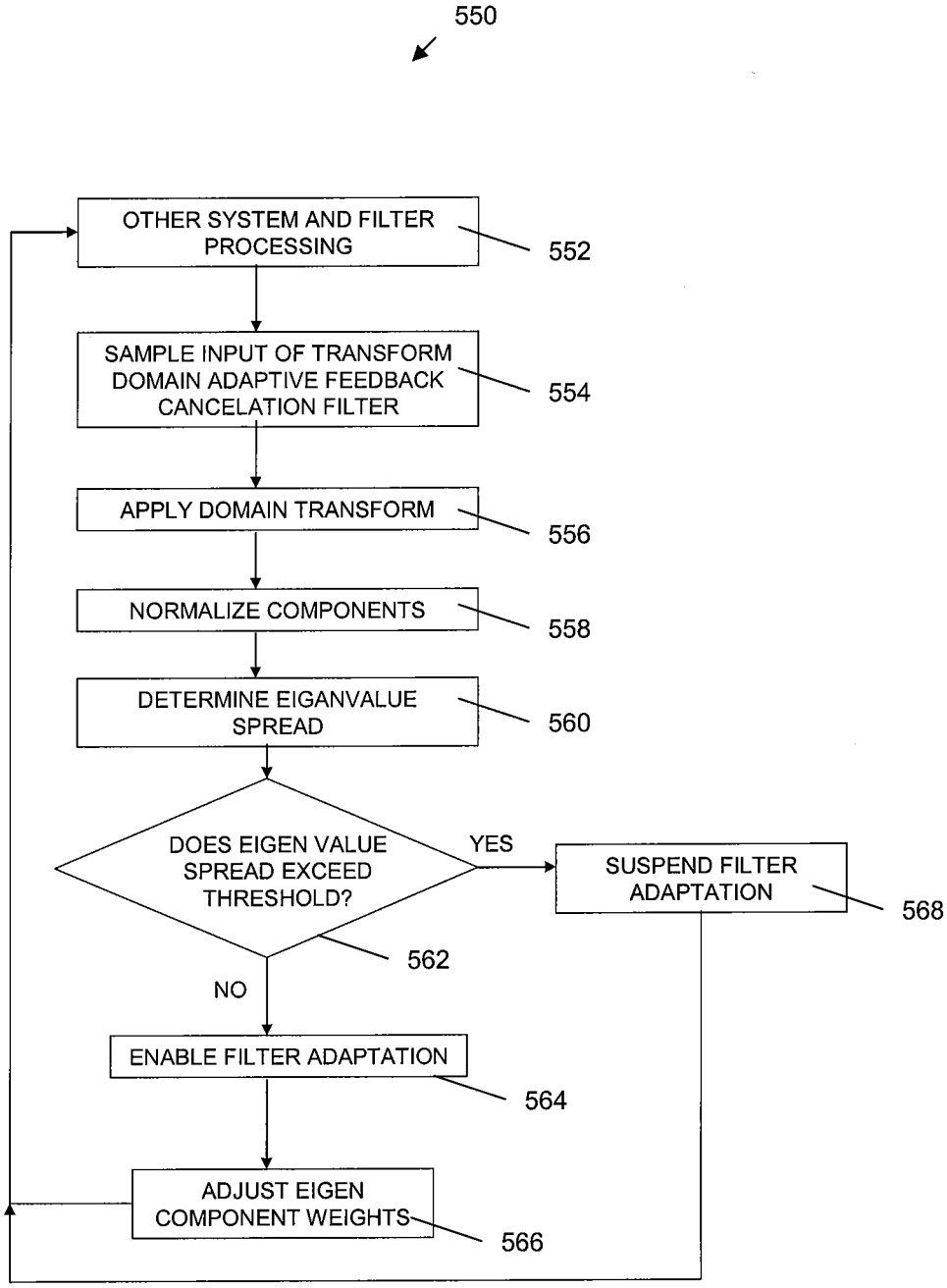
FIG. 5 is a flow diagram showing one example of a method of entrainment avoidance according to one embodiment of the present subject matter.

FIG. 5 is a flow diagram showing one example of a method of entrainment avoidance 550 according to one embodiment of the present subject matter. In this embodiment, various systems perform other signal processing 552 associated with feedback cancellation while monitoring and avoiding entrainment of a transform domain adaptive feedback cancellation filter. The input of the transform domain adaptive feedback cancellation filter are sampled into digital delay components 554. The digital delay components are processed by a transform to form an input auto-correlation matrix 556. In various embodiments, the transform is a discrete Fourier transform (DFT). In various embodiments, the transform is a discrete Cosine transform (DCT). The transformed signals are normalized by a square root of their powers 558. The processor monitors the eigenvalues and determines the eigenvalue spread of the input auto correlation matrix 560. If the eigenvalue spread does not violate a predetermined threshold value or condition 562, adaptation is enable 564, if it was not enabled, and the normalized eigen components are weighted 566 and subsequently recombined to form the output of the cancellation filter. If the eigenvalue spread violates a predetermined threshold value or condition 562, adaptation is suspended 568 and the normalized eigen components are scaled using previous weights and subsequently recombined to form the output of the cancellation filter. In various embodiments, each eigen component's weight is adjusted based on Least Mean Square (LMS) algorithm and each eigen component represents a particular frequency band. It is understood that some changes in the process and variations in acts performed may be made which do not depart from the scope of the present subject matter.

Figure 4A:
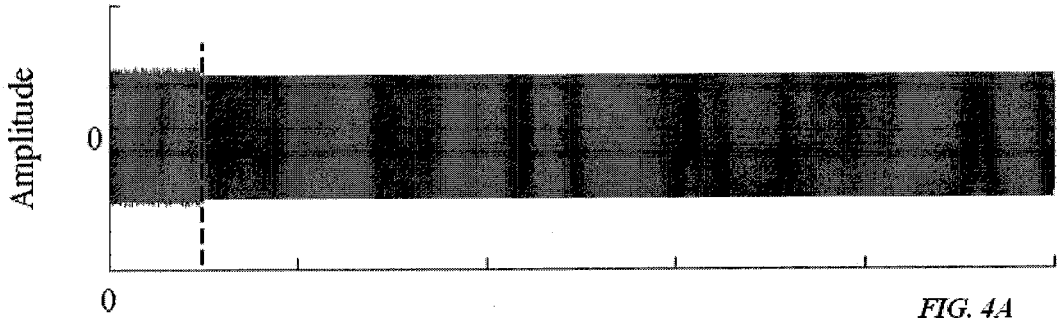
FIGS. 4A and 4B illustrate the response of the entrainment avoidance system embodiment of FIG. 2 using a signal processor to monitor and modulate the adaptation of an adaptive feedback cancellation filter using the eigenvalue spread of an input autocorrelation matrix calculated using a transform domain algorithm.
Figure 4B:
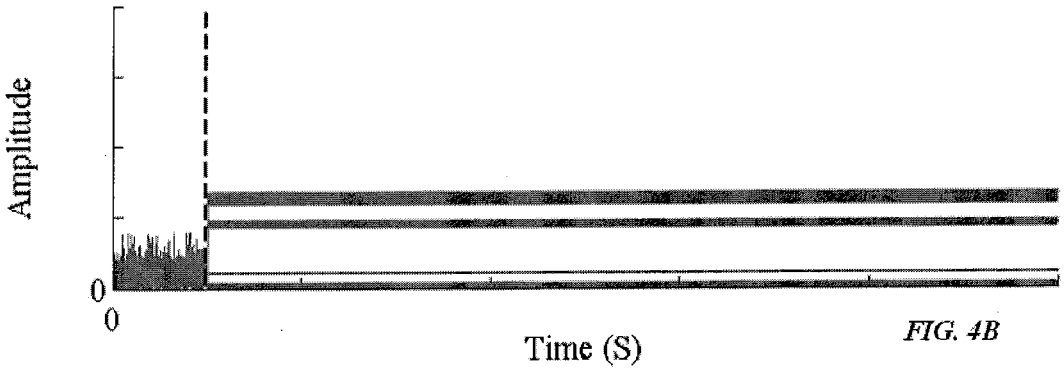

FIG. 4A-B illustrates the response of the entrainment avoidance system embodiment of FIG. 2 using a signal processor to monitor and modulate the adaptation of an adaptive feedback cancellation filter using the eigenvalue spread of an input autocorrelation matrix calculated using a transform domain algorithm. Upon indication of entrainment, the system prohibited the adaptive feedback cancellation filter from adapting. FIG. 4A shows the system outputting a interval of white noise followed by a interval of tonal signal closely replicating the input to the system represented by the signal illustrated in FIG. 3A. FIG. 4B illustrates a representation of eigenvalues from the input autocorrelation matrix of the adaptive feedback canceller where adaptation is controlled depending on the spread of the eigenvalues of the input autocorrelation matrix. FIG. 4B shows the eigenvalues do spread from the values during the white noise interval, however, the eigenvalues do not fluctuate and diverge as rapidly and extremely as the eigenvalues in the FIG. 3C.

The DCT LMS entrainment avoidance algorithm was compared with the NLMS feedback canceller algorithm to derive a relative complexity. The complexity calculation was done only for the canceller path. For the above reason, we used a M stage discrete cosine transform adaptive algorithm. This algorithm has faster convergence for slightly colored signals compared to the NLMS algorithm. In summery, the DCT-LMS entrainment avoidance algorithm has ~$M^2/2+8M$ complex and ~$M^2/2+8M$ simple operations. The $\bar{u}_t=u_tT$ vector multiplication computation uses ~3M operations when redundancies are eliminated. The block version of the algorithm has significant complexity reductions.

The results of FIGS. 4A-B were generated with a typical acoustic leakage path (22 tap) with a 16 tap DCT-LMS adaptive feedback canceller with eigenvalue control. Each data point is created by averaging 20 runs (N=20). Each audio file is 10 seconds in duration, 5 seconds of white noise followed by 5 seconds of tonal signal. The level drop is calculated as the ratio of output level while white noise to the final tonal signal level. Level drops are adaptation rate dependent. Frequency also factors into level drops but to much smaller extent than the adaptation rate dependency. Most level reductions are less than 9% of the original signal and not perceivable to the normal or hearing impaired listeners.

This application is intended to cover adaptations and variations of the present subject matter. It is to be understood that the above description is intended to be illustrative, and not restrictive. The scope of the present subject matter should be determined with reference to the appended claim, along with the full scope of equivalents to which the claims are entitled.

What is claimed is:

1. A method of signal processing an input signal in a hearing aid to avoid entrainment, the hearing aid including a receiver and a microphone, the method comprising:

using a transform domain adaptive feedback cancellation filter to measure an acoustic feedback path from the receiver to the microphone, including separating an input of the transform domain adaptive feedback cancellation filter to a plurality of eigen components each representing a particular frequency band;

analyzing a measure of eigenvalue spread of the plurality of eigen components against a threshold for indication of entrainment of the transform domain adaptive feedback cancellation filter, the threshold being a predetermined constant; and upon indication of entrainment of the transform domain adaptive feedback cancellation filter, modulating adaptation of the transform domain adaptive feedback cancellation filter.

2. The method of claim 1, wherein modulating the adaptation of the transform domain adaptive feedback cancellation filter upon indication of entrainment includes reducing an adaptation rate of the transform domain adaptive feedback cancellation filter.

3. The method of claim 1, wherein modulating the adaptation upon indication of entrainment includes suspending the adaptation of the transform domain adaptive feedback cancellation filter.

4. The method of claim 1, wherein using the transform domain adaptive feedback cancellation filter includes applying a domain transform to the input of the transform domain adaptive feedback cancellation filter.

5. The method of claim 4, wherein applying the transform domain include applying a discrete Fourier transform (DFT).

6. The method of claim 4, wherein applying the transform domain include applying a discrete cosine transform (DCT).

7. The method of claim 4, wherein applying the transform domain includes applying a discrete Hartley transform (DHT).

8. The method of claim 1, wherein using the transform domain adaptive feedback cancellation filter includes:

comparing the measure of eigenvalue spread to the threshold for the indication of entrainment of the transform domain adaptive feedback cancellation filter;

normalizing and weighting the plurality of eigen components; and combining the normalized and weighted plurality of eigen components into an output of the transform domain adaptive feedback cancellation filter.

9. The method of claim 1, comprising determining the threshold based on an adaptation rate of the transform domain adaptive feedback cancellation filter and eigenvalue spread associated with entrainment prone signals.

10. An apparatus comprising:

a microphone;

a signal processor to process signals received from the microphone, the signal processor including a transform domain adaptive feedback cancellation filter, the transform domain adaptive feedback cancellation filter configured to provide an estimate of an acoustic feedback path for feedback cancellation and including a pre-filter configured to separate an input of the transform domain adaptive feedback cancellation filter to a plurality of eigen components each representing a particular frequency band; and a receiver adapted for emitting sound based on the processed signals, wherein the signal processor is adapted to detect entrainment of the transform domain adaptive feedback cancellation filter using an outcome of comparing a measure of eigenvalue spread of the plurality of eigen components to a predetermined threshold constant.

11. The apparatus of claim 10, wherein the transform domain adaptive feedback cancellation filter includes an adaptation controller to update a plurality of filter coefficients.

12. The apparatus of claim 11, wherein the adaptation controller is adapted to monitor one or more least mean square values of a processed input signal of the processed signals to update the plurality of filter coefficients.

13. The apparatus of claim 10, wherein the signal processor is adapted to modulate adaptation of the transform domain adaptive feedback cancellation filter upon detection of the entrainment of the transform domain adaptive feedback cancellation filter.

14. The apparatus of claim 10, further comprising a housing to enclose the signal processor.

15. The apparatus of claim 14, wherein the housing is a behind-the-ear (BTE) housing.

16. The apparatus of claim 14, wherein the housing is an in-the-canal (ITC) housing.

17. The apparatus of claim 14, wherein the housing is a completely-in-the-canal housing.

18. The apparatus of claim 10, wherein the signal processor is adapted to compute a transform domain of the input of the transform domain adaptive feedback cancellation filter.

19. The apparatus of claim 10, wherein the signal processor includes instructions to reduce an adaptation rate of the transform domain adaptive feedback cancellation filter upon indication of entrainment of the transform domain adaptive feedback cancellation filter.

20. The apparatus of claim 10, wherein the signal processor includes instructions to suspend adaptation of the transform domain adaptive feedback cancellation filter upon indication of entrainment of the transform domain adaptive feedback cancellation filter.

* * * * *